US012808075B2

(12) United States Patent
Scheiff et al.

(10) Patent No.: US 12,808,075 B2
(45) **Date of Patent: *Nov. 24, 2026**

(54) METHOD AND SYSTEM FOR USING THE CARBON OXIDE ARISING IN THE PRODUCTION OF ALUMINIUM

(71) Applicants: BASF SE, Ludwigshafen am Rhein (DE); thyssenkrupp AG, Essen (DE); thyssenkrupp Uhde GmbH, Dortmund (DE)

(72) Inventors: Frederik Scheiff, Ludwigshafen (DE); Marc Leduc, Ludwigshafen (DE); Andreas Bode, Ludwigshafen (DE); Karsten Bueker, Dortmund (DE); Nicolai Antweiler, Essen (DE)

(73) Assignees: BASF SE, Ludwigshafen am Rhein (DE); thyssenkrupp AG, Essen (DE); thyssenkrupp Uhde GmbH, Dortmund (DE)

( * ) Notice: Subject to any disclaimer, the term of this patent is extended or adjusted under 35 U.S.C. 154(b) by 1393 days.

This patent is subject to a terminal disclaimer.

(21) Appl. No.: 17/595,982

(22) PCT Filed: May 28, 2020

(86) PCT No.: PCT/EP2020/064777
§ 371 (c)(1),
(2) Date: Dec. 1, 2021

(87) PCT Pub. No.: WO2020/245014
PCT Pub. Date: Dec. 10, 2020

(65) Prior Publication Data

US 2022/0235479 A1 Jul. 28, 2022

(30) Foreign Application Priority Data

Jun. 5, 2019 (EP) ..... 19178457

(51) Int. Cl.
*C25C 3/22* (2006.01)
*C25C 3/12* (2006.01)

(52) U.S. Cl.
CPC ..... *C25C 3/22* (2013.01); *C25C 3/125* (2013.01)

(58) Field of Classification Search
CPC ..... C25C 3/22; C25C 3/12; C25C 3/125
See application file for complete search history.

(56) References Cited

U.S. PATENT DOCUMENTS 2,982,622 A * 5/1961 Silveston ..... C10B 55/10 208/126
3,284,334 A 11/1966 Joseph et al.
(Continued)

FOREIGN PATENT DOCUMENTS

CA 2969558 A1 6/2016
CN 103059899 A 4/2013
(Continued)

OTHER PUBLICATIONS

CN 105801354 A1 machine translated (Year: 2016).*
(Continued)

*Primary Examiner* — Luan V Van
(74) *Attorney, Agent, or Firm* — Grüneberg Global IP, PLLC

(57) ABSTRACT

A process can utilize carbon oxides formed in the production of aluminum, by electrolytic reduction of aluminum oxide in a melt using at least one anode made of a carbon-comprising material. A pyrolysis of hydrocarbons, in particular methane or natural gas, is carried out in which pyrolysis carbon and hydrogen are formed. The pyrolysis carbon is used for the production of the at least one anode. The hydrogen formed in the pyrolysis of methane is mixed with carbon dioxide and/or carbon monoxide from the electrolytic production of
(Continued)

aluminum, to produce a gas stream which is parsed to a further use. An integrated plant contains an electrolysis apparatus for producing aluminum by melt-electrolytic reduction of aluminum oxide, and also contains at least one reactor in which pyrolysis carbon and hydrogen are produced by pyrolysis of hydrocarbons.

10 Claims, 2 Drawing Sheets

(56) References Cited

U.S. PATENT DOCUMENTS

| | | | | |
|---|---|---|---|---|
| 3,427,240 | A | 2/1969 | Landrum et al. | |
| 5,316,565 | A * | 5/1994 | Kibby | C22B 21/02 75/10.36 |
| 8,168,143 | B2 | 5/2012 | Severinsky | |
| 12,351,926 | B2 * | 7/2025 | Scheiff | C25C 3/22 |
| 2008/0023321 | A1 * | 1/2008 | Sadoway | C25B 11/04 204/243.1 |
| 2020/0047120 | A1 * | 2/2020 | Fulde | C07C 1/0485 |

FOREIGN PATENT DOCUMENTS

| | | | | |
|---|---|---|---|---|
| CN | 105801354 | A * | 7/2016 | C07C 29/151 |
| DE | 102013102969 | A1 | 9/2014 | |
| EP | 0635045 | B1 | 2/1996 | |
| JP | S56-163291 | A | 12/1981 | |
| RU | 118967 | U1 | 8/2012 | |
| RU | 2532200 | C2 | 10/2014 | |
| WO | WO-2011/021025 | A1 | 2/2011 | |
| WO | WO-2014/095661 | A1 | 6/2014 | |

OTHER PUBLICATIONS

Aluminum production (Year: 2015).*

Aarhaug, et al., "A Study of Anode Baking Gas Composition", Light Metals, TMS Annual Meeting & Exhibition, The Minerals, Metals & Materials Series, ed. O. Martin, Feb. 2, 2018, pp. 1379-1385.

Aarhaug, et al., "Aluminium Primary Production Off-Gas Composition and Emissions: An Overview", JOM, vol. 71, Issue 9, Feb. 19, 2019, pp. 2966-2977.

European Search Report for EP Patent Application No. 19178457.8, Issued on Dec. 18, 2019, 3 pages.

International Search Report for PCT Patent Application No. PCT/EP2020/064777, Issued on Jul. 21, 2020, with English translation, 5 pages.

* cited by examiner

METHOD AND SYSTEM FOR USING THE CARBON OXIDE ARISING IN THE PRODUCTION OF ALUMINIUM

CROSS-REFERENCE TO RELATED APPLICATIONS

This application is the National Stage entry under § 371 of International Application No. PCT/EP2020/064777, filed on May 28, 2020, and which claims the benefit of priority to European Application No. 19178457.8, filed on Jun. 5, 2019. The content of each of these applications is hereby incorporated by reference in its entirety.

BACKGROUND OF THE INVENTION

Field of the Invention

The present invention relates to a process for utilizing the carbon oxides formed in the production of aluminum by electrolytic reduction of aluminum oxide in the melt using at least one anode made of a carbon-containing material, where a pyrolysis carbon is used for producing the at least one anode, where a pyrolysis of hydrocarbons, in particular natural gas or methane, in which pyrolysis carbon and hydrogen are formed is carried out. The present invention also provides an integrated plant comprising an electrolysis apparatus for producing aluminum by melt-electrolytic reduction of aluminum oxide.

Description of Related Art

The production of aluminum is carried out predominantly by melt flux electrolysis by the Hall-Heroult process. In this process, a eutectic mixture of the low-melting aluminum mineral cryolite ($Na_3[AlF_6]$) and the high-melting aluminum oxide (alumina) is subjected to melt flux electrolysis, with the aluminum oxide being reduced. Aluminum oxide is present dissociated into its ions in the melt.

$$Al_2O_3 \rightarrow 2Al^{3+} + 3O^{2-}$$

The aluminum ions present in the melt migrate to the cathode where they take up electrons and are reduced to aluminum atoms.

$$Al^{3+} + 3e^- \rightarrow Al$$

The negative oxygen ions $O^{2-}$ migrate to the anode, release excess electrons and react with the carbon of the anode to form carbon monoxide and carbon dioxide, which are evolved as gases.

$$C + 2O^{2+} \rightarrow CO_2 + 4e^-$$

$$C + 2O^{2-} \rightarrow CO_2 + 4e^-$$

The overall reaction equation for the Hall-Heroult process is thus as follows:

$$2Al_2O_3 + 3C \rightarrow 4Al + 3CO_2$$

Large amounts of carbon dioxide ($CO_2$) and carbon monoxide (CO) are formed in the reduction of aluminum oxide to aluminum: Apart from these two gases, sulfur dioxide ($SO_2$) and hydrogen fluoride (HF) are emitted. Carbon tetrafluoride ($CF_4$), hexafluoroethane ($C_2F_6$), sulfur hexafluoride ($SF_6$) and silicon tetrafluoride ($SiF_4$) are likewise relevant in terms of melt at low oxygen concentrations. The components $CO_2$, CO and $SO_2$ result from burning of the anodes. The calcined petroleum coke used, which comes from the processing of crude oil to give fuels, comprises proportions of sulfur, depending on quality, in the range from, for example, 1 to 7% by weight. In many cases, the offgases from aluminum production are released into the atmosphere [Aarhaug et al., "Aluminium Primary Production Off-Gas Composition and Emissions: An Overview", JOM, Vol. 71, No, 9, 2019]. In the case of emissions of $SO_2$ and HF, particular permitted limit values must not be exceeded. In addition, the emissions of gases which damage the climate are being increasingly regulated. About 7% of worldwide industrial energy consumption and 2.5% of anthropogenic greenhouse gases are attributable to aluminum production. In the life cycle of primary aluminum production, up to 20 $CO_2$ equivalents can arise per kg of aluminum. In Germany in the year 2018, the $CO_2$ emissions amounted to about 1 million metric tons of carbon dioxide equivalents (greenhouse gas emissions 2018 (VET_Bericht 2018)). Perfluorinated hydrocarbons (PFHCs) are formed by an increased voltage which occurs at a proportion of dissolved aluminum oxide ($Al_2O_3$) which is too low. Strategies for reducing the emissions of the Hall-Heroult process for producing aluminum are therefore of great economic and ecological interest.

The U.S. Pat. No. 3,284,334 A describes a process for the pyrolysis of hydrocarbons, in which pyrolysis carbon and hydrogen are formed. The pyrolysis carbon produced in this way has a great hardness, high density and low porosity and is suitable for the production of electrodes, with pitch being added as binder. Such electrodes are suitable for the electrowinning of aluminum from its ores.

EP 0 635 045 B1 describes the production of pure pyrolysis carbon by decomposition of methane, with hydrogen being formed in addition to the carbon. Here, a methane-containing starting material is used and this is decomposed in a plasma burner at above 1600° C. In this document, too, it is stated that carbon produced pyrolytically in this way is suitable for the production of anodes for the electrolysis of aluminum ores because of its specific properties.

SUMMARY OF THE INVENTION

It is an object of the present invention to provide a process of the type mentioned at the outset, in which the carbon oxides formed in the production of aluminum can be passed to a purposeful use. In particular, it is desirable for this purposeful use of the carbon oxides formed to be as close in terms of physical distance as possible to the place where they arise.

A further object was to pass the offgases formed in the production of anodes to a purposeful use.

The abovementioned objects are achieved by a process of the abovementioned type having the features as described, and an integrated plant having the features as described.

DETAILED DESCRIPTION OF THE INVENTION

Figure 1:
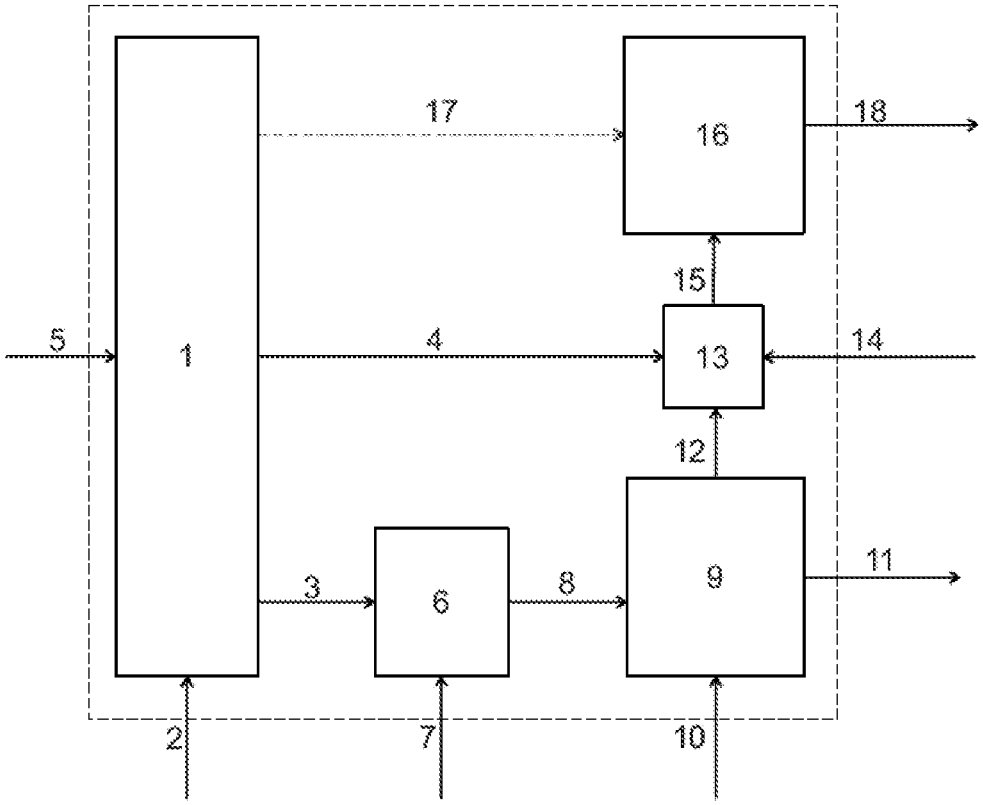
FIG. 1 shows a schematic simplified plant flow diagram of a plant according to the invention for utilizing carbon oxides formed in the melt-electrolytic production of aluminum.

According to the invention, the hydrogen formed in the pyrolysis of hydrocarbons is mixed with carbon dioxide and/or carbon monoxide from the electrolytic production of aluminum, producing a gas stream which can be passed to a further use. The basic idea of the present invention is thus to combine the process of production of the electrodes for the melt flux electrolysis of aluminum by pyrolysis with the melt flux electrolysis itself, with the hydrocarbons formed in addition to the pyrolysis carbon in the one process being combined with the environmentally damaging carbon oxides formed in the second process, namely the electrolysis of aluminum, to give a gas mixture which has a useful composition which makes it possible for this gas mixture to be technically utilized further in various processes.

Especially in the creation of an integrated plant comprising plant regions in which pyrolysis of methane to produce anodes is carried out and plant regions in which the melt flux electrolysis for production of aluminum is carried out, the carbon oxides formed in the production of aluminum and optionally the offgases formed in anode production can be purposefully utilized in the physical vicinity of the place at which they arise.

In a preferred further development of the process of the invention, a hydrogen-comprising gas stream and a gas stream comprising carbon dioxide and/or carbon monoxide or a gas stream comprising a mixture of hydrogen and carbon dioxide and/or carbon monoxide is subsequently fed to a reverse water gas shift reaction in which at least part of the carbon dioxide is reacted with hydrogen and reduced to carbon monoxide so as to produce a synthesis gas stream.

"Synthesis gas" in the narrower sense refers to industrially produced gas mixtures comprising hydrogen and carbon monoxide and also further gases. Depending on the ratio in which hydrogen and carbon monoxide are comprised in the gas mixture, various products can be produced from synthesis gas, for example liquid fuels by the Fischer-Tropsch process at a ratio of hydrogen to carbon monoxide of 1-2:1, alcohols such as methanol or ethanol at a ratio of about 2:1, or methane or synthetic natural gas (SNG) by methanation at a ratio of about 3:1.

The water gas shift reaction is usually employed for decreasing the proportion of carbon monoxide in the synthesis gas and for producing further hydrogen. This occurs according to the following reaction equation:

$$CO+H_2O \rightarrow CO_2+H_2 \quad (2)$$

The abovementioned reaction (2) is an equal reaction which proceeds in the reverse direction under altered reaction conditions, for example if the temperature is increased. This reverse reaction will here be referred to as reverse water gas shift reaction and corresponds to the reaction equation indicated below:

$$CO_2+H_2 \rightarrow CO+H_2 \quad (3)$$

In a preferred further development of the process of the invention, the abovementioned reaction (3) can thus be utilized for converting a proportion of the carbon dioxide formed in the melt flux electrolysis of aluminum oxide into carbon monoxide by reaction with hydrogen from the pyrolysis of hydrocarbons or from another source in order to produce further carbon monoxide and provide a synthesis gas which has a higher proportion of carbon monoxide and at the same time a reduced content of carbon dioxide, so that this synthesis gas mixture has a composition which is particularly suitable for specific further reactions.

In parallel with the reverse water gas shift reaction, part, e.g. from 30 to 80% by volume, of the carbon oxides formed in aluminum production can be fed into the methane pyrolysis reactor (see WO 2014/95661).

This reaction occurs according to the following reaction equations:

$$CO_2+CH_4 \rightarrow 2CO+2H_2$$

$$CF_4+2H_2 \rightarrow C+4HF$$

$$C_2F_6+3H_2 \rightarrow 2C+6HF$$

When using a plurality of pyrolysis reactors in parallel, it is advantageous to carry out the reaction of the carbon oxides formed in aluminum production to form synthesis gas, hydrogen fluoride and carbon in some of these reactors and carry out the pyrolysis of methane to form hydrogen and carbon in the other reactors.

When, for example, the ratio of carbon monoxide to carbon dioxide in the synthesis gas mixture is comparatively high, the synthesis gas mixture can, in a preferred variant of the present invention, be utilized, for example, together with hydrogen in a chemical or biotechnological plant.

In the chemical plant, the synthesis gas obtained can, for example, be methanized:

$$CO+3H_2 \rightarrow CH_4+H_2O$$

The methane obtained is advantageously recirculated to the methane pyrolysis process and used for producing the carbon anodes. Carbon emissions can be avoided in this way. Overall, hydrogen is thus used as reducing agent for the aluminum oxide:

Methane pyrolysis (target reaction):

$$CH_8 \rightarrow C+2H_2$$

Hall-Heroult.

$$2Al_2O_3+3C \rightarrow 4Al+3CO_2$$

Methane pyrolysis (secondary reaction):

$$CO_2+4H_2 \rightarrow CH_4+2H_2O$$

The methane product gas stream is advantageously dried, for example using a molecular sieve drier or a gamma-$Al_2O_3$ drier, before recirculation to the pyrolysis reactor.

Overall, Hall-Heroult:

$$Al_2O_3+3H_2 \rightarrow 2Al+3H_2O$$

In a preferred further development of the process of the invention, the synthesis gas stream is used for producing methanol, at least one alcohol and/or at least one other chemical of value. For the present purposes, other chemicals of value are organic compounds based on carbon of effectively any type which can be produced from synthesis gases, for example olefins, aldehydes, ethers, etc., with the aid of production processes known per se, or else fuels or fuel mixtures such as gasoline or diesel or energy-rich gases such as methane or other higher gaseous or liquid hydrocarbons and the like.

In a preferred further development of the process of the invention, the ratio of carbon dioxide and carbon monoxide in the gas stream obtained in the electrolytic production of aluminum is set via selection of the anodic current density in the electrolysis. The anodic current density is one of a number of possible parameters which influence the ratio of carbon dioxide to carbon monoxide in the gas mixture formed by burning of the anodes in the melt electrolysis of aluminum oxide. This reaction and the ratio in which the two carbon oxides are formed are governed by the following two equations:

$$2Al_2O_3 \rightarrow 4Al+3O_2 \quad (4)$$

$$3/2O_2+xC \rightarrow mCO_2+nCO \quad (5)$$

where x=1.5 y; m=1.5 yn 2y: and $0.5 \leq y \leq 1.5$

From the above reaction equation (5) and the associated parameters x, y, m and n, it can be seen that as the parameter y becomes smaller, the relative proportion of $CO_2$ in the gas mixture increases, while the proportion of CO decreases. In the following, an illustrative calculation is carried out under the assumption that y assumes the value 1. "x" is then equal to 2.5, "m" is equal to 0.5, "n" is equal to 2, so that the above equation (5) becomes, when using these values:

$$3/2O_2+2.5C \rightarrow 0.5CO_2+2CO$$

As values of "y" become smaller, for example less than 1, the proportion of $CO_2$ increases at the same time and the proportion of CO decreases, so that when a high proportion of CO in the gas mixture is desired, which is generally more favorable for the typical composition of a synthesis gas, a larger value for "y" is advantageous.

If the possible limit values for "y" are assumed, then when y=0.5

$$3/2O_2+2C \rightarrow CO_2+CO$$

and when y=1.5

$$3/2O_2+3C \rightarrow 0CO_2+3CO$$

In the pyrolysis of methane, one mol of C and two mol of $H_2$ are formed from one mol of $CH_4$. In the reduction of $Al_2O_3$, 4 mol of Al and 3 mol $O_2$ are formed from 2 mol of $Al_2O_3$. The oxygen reacts with the carbon to form $CO_2$ and CO. At the limits of y, 1 mol of $CO_2$ and 1 mol of CO are formed from 1.5 mol of $O_2$ and 2 mol of C, or 3 mol of CO are formed from 1.5 mol of $O_2$ and 3 mol of C.

In the reverse water gas shift reaction, one mol of CO and one mol of water are formed from one mol of hydrogen and one mol of $CO_2$. Overall, for the limit values of y:

When y=0.5: $Al_2O_3+2CH_4 \rightarrow 2Al+3H_2+2CO+H_2O$

When y=1.5: $Al_2O_3+3CH_3 \rightarrow 2Al+6H_2+3CO$

When a higher ratio of $H_2/CO$ is set, an excess of pyrolysis carbon is present or when other carbon sources are used, a correspondingly lower ratio is present. A further advantage of the pyrolysis carbon is that virtually no sulfur is comprised therein and the sulfur emissions in the electrolysis of aluminum oxide are thus drastically reduced.

A further parameter by means of which, in a preferred further development of the process of the invention, the value "y" in the above reaction equation (5) can be influenced and the ratio of carbon dioxide and carbon monoxide in the gas stream obtained in the electrolytic production of aluminum can thus be set is the temperature of the electrolyte selected in each case.

A third possible parameter by means of which, in a preferred further development of the process of the invention, the value "y" in the above reaction equation (5) and the ratio of carbon dioxide and carbon monoxide in the gas stream obtained in the electrolytic production of aluminum can thus be set is the selection of the reactivity of the pyrolysis carbon material of the anode.

The present invention further provides an integrated plant comprising an electrolysis apparatus for producing aluminum by melt-electrolytic reduction of aluminum oxide, wherein the integrated plant further comprises at least one reactor in which pyrolysis carbon and hydrogen are produced by pyrolysis of hydrocarbons, in particular methane or natural gas, where this reactor is preferably located in the physical vicinity of the electrolysis apparatus. Furthermore, the integrated plant of the invention advantageously comprises at least one apparatus in which anodes for the electrolysis of aluminum are produced from pyrolysis carbon or a carbon mixture comprising pyrolysis carbon. Furthermore, the integrated plant of the invention advantageously comprises at least one apparatus in which hydrogen from the pyrolysis is mixed with carbon oxides from the aluminum electrolysis. Furthermore, the integrated plant of the invention advantageously comprises at least one feed device for the resulting gas mixture to a further use.

In such an integrated plant according to the invention comprising a reactor for hydrocarbon pyrolysis and a plant for producing aluminum by melt flux electrolysis, methane, for example, can be pyrolyzed with input of energy in the reactor, forming hydrogen and a pyrolysis carbon which, owing to its composition and morphology, is well suited to production of anodes for the melt flux electrolysis. The production of the anodes requires only an additional binder, for example pitch or a mixture of different carbons such as pyrolysis carbon mixed with calcined petroleum coke, optionally together with a binder.

The volatile hydrocarbons formed in the production of the anode (see, for example, Aarhaug et al., "A Study of Anode Baking Gas Composition", Light Metals 2018, pp. 1379-1385), in particular methane, benzene and polycyclic aromatics, can advantageously be recirculated to the reactor for hydrocarbon pyrolysis. For example, these volatile hydrocarbons are conveyed via a conduit (19) from the apparatus for anode production (6) into the reactor for hydrocarbon pyrolysis (1) or these volatile hydrocarbons are introduced via a conduit (19) into the feed conduit (2) for methane or other hydrocarbons and thus into the reactor for hydrocarbon pyrolysis (1).

The perfluorinated hydrocarbons, PFHCs, which may be present in the anode offgas are converted into hydrogen fluoride in the methane pyrolysis. The hydrogen fluoride is advantageously removed from the gas stream, for example adsorbed/absorbed with the aid of Al2O3 or $Al(OH)_3$. The fluoride-laden adsorbent is advantageously added to the cryolite melt and the fluoride is thus circulated.

In a preferred further development of the invention, the integrated plant thus further comprises an apparatus in which anodes for the electrolysis of aluminum are produced from the pyrolysis carbon produced in the reactor by pyrolysis of hydrocarbons, in particular methane or natural gas. The pyrolysis carbon, optionally further carbon materials such as petroleum coke, and additionally the binder are fed to this apparatus. In this variant of the invention, it is particularly advantageous that the pyrolysis carbon can be processed effectively at the place where it is produced within the same integrated plant to give the anodes which can then be used directly in the melt flux electrolysis for the production of aluminum, likewise in the same integrated plant. Great advantages also arise from the in-house supply with pyrolysis carbon and the opportunity of using sometimes inexpensive calcined petroleum coke having relatively high proportions of sulfur, since the pyrolysis carbon does not comprise any sulfur and can thus compensate for relatively high sulfur contents of other carbon components.

In a preferred further development of the invention, the integrated plant further comprises at least one device in which a reverse water gas shift reaction is carried out and which is in functional communication with the reactor in which the pyrolysis of the hydrocarbons occurs. The Hall-Heroult process for the reduction of aluminum oxide dissolved in cryolite forms not only aluminum but also carbon dioxide and carbon monoxide as a result of burning of the anodes. These two gases can be fed together with a stream of hydrogen from the pyrolysis of methane to the above-mentioned device, for example a reactor, in which the reverse water gas shift reaction (see equation (3) above) is carried out. In this reaction, the proportion of carbon dioxide in the gas mixture is reduced with input of energy and the proportion of carbon monoxide in the gas mixture is increased. For the purposes of the present invention, particular preference is given to an integrated plant in which the melt flux electrolysis for aluminum production and the reactor for the pyrolysis of hydrocarbons, for example methane, and the device in which the reverse water gas shift reaction takes place are arranged in the physical vicinity of one another so that the transfer of the gases for the reverse water gas shift reaction, i.e. the hydrogen from the pyrolysis and the carbon oxides formed by burning of the anodes in the melt flux electrolysis, is preferably possible via the conduits connecting the individual regions of the integrated plant without excessive conduit lengths.

In a preferred further development of the invention, the integrated plant further comprises at least one chemical or biotechnological plant which is in functional communication with the rector or with the device in which a reverse water gas shift reaction is carried out. This chemical or biotechnological plant can be supplied with hydrogen from the methane pyrolysis, for example directly from the pyrolysis reactor, by connecting this reactor via at least one conduit to the chemical or biotechnological plant. On the other hand, a synthesis gas which has been produced in the device by means of a reverse water gas shift reaction from carbon monoxide and carbon dioxide originating from burning of the anodes of the melt flux electrolysis with enrichment with carbon monoxide and addition of hydrogen originating from the methane pyrolysis can also be fed to the chemical or biotechnological plant via at least one conduit connecting the device to this plant. In the latter variant, the hydrogen is thus not fed directly from the pyrolysis to the plant but instead together with the synthesis gas previously produced in the water gas shift reaction.

In a preferred further development of the invention, the apparatus for producing anodes from carbon obtained by pyrolysis is connected via a feed device to the reactor for methane pyrolysis, with the apparatus being supplied via this feed device with carbon produced pyrolytically in the reactor or a carbon mixture, i.e., for example, a mixture of calcined petroleum coke and pyrolysis carbon, and the apparatus optionally being supplied via a further feed device with a binder. The anodes produced in this way from pyrolytic carbon and binder can be used directly in the plant for the melt-electrolytic winning of aluminum within the integrated plant. When a carbon mixture is used, the carbon components are mixed and baked together with a binder, for example pitch, in a high-temperature process to give anodes.

In a preferred further development of the invention, the integrated plant comprises at least one conduit for hydrogen which leads from the reactor to the chemical or biotechnological plant and/or at least one conduit for hydrogen which leads from the reactor to the device in which a reverse water gas shift reaction is carried out. This gives the abovementioned two variants in which either the hydrogen obtained in the pyrolysis is fed directly from the pyrolysis reactor to the chemical or biotechnological plant, or the hydrogen is fed to the device in which the synthesis gas is produced by means of a reverse water gas shift reaction.

In a preferred further development of the invention, the integrated plant comprises at least one conduit for carbon dioxide and/or carbon monoxide which leads from the electrolysis apparatus to the device in which a reverse water gas shift reaction is carried out. The mixture of carbon dioxide and carbon monoxide produced by oxidation at the anode during the electrolysis is conveyed via such a conduit to the device in which it is mixed with hydrogen from the pyrolysis reactor so as to produce a synthesis gas, with the proportion of carbon monoxide optionally being able to be increased by the reverse water gas shift reaction.

In a preferred further development of the invention, the integrated plant comprises at least one conduit for synthesis gas comprising at least carbon monoxide and hydrogen, which conduit leads from the device in which a reverse water gas shift reaction is carried out to the chemical or biotechnological plant. The synthesis gas produced in the reverse water gas shift reaction is fed via this at least one conduit to the chemical or biotechnological plant.

If all the abovementioned optional variants of the invention are realized, the integrated plant thus comprises in total at least five plant parts, namely a reactor in which the methane pyrolysis takes place, an apparatus in which the anodes are produced from the pyrolysis carbon, a plant in which the melt flux electrolysis of aluminum oxide takes place, a reactor in which the reverse water gas shift reaction is carried out and also a chemical or biotechnological plant in which chemical compounds or biotechnological products can be produced from the previously produced synthesis gas. The abovementioned plant parts of the integrated plant are advantageously combined via conduits and/or pipes and/or other suitable transport or feed devices to form an integrated plant in such a way that the intermediates produced in the individual plant parts of the integrated plant can be supplied to the respective other plant parts in which the further reaction of the intermediates by the process of the invention is envisaged.

Figure 2:
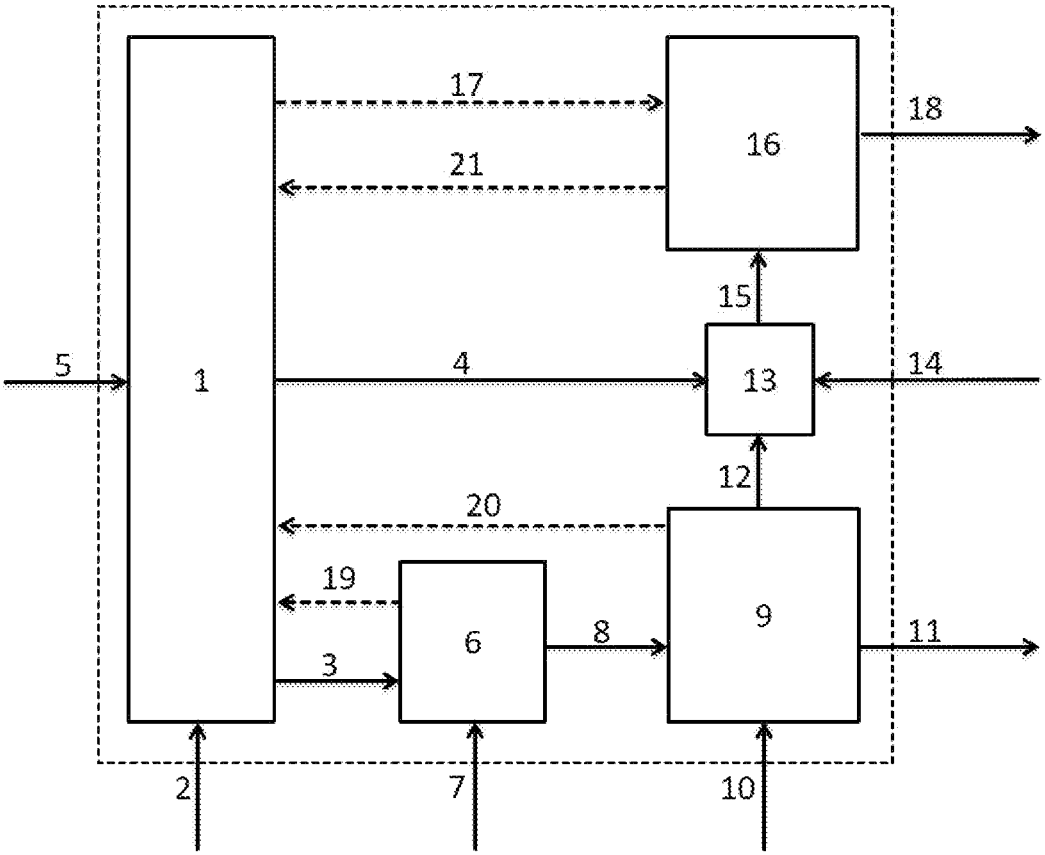
FIG. 2 shows another schematic simplified plant flow diagram of a plant according to the invention for utilizing carbon oxides formed in the melt-electrolytic production of aluminum.

The present invention will be illustrated below with the aid of working examples with reference to the accompanying drawings. The drawings show:

FIGS. 1 and 2 a schematic simplified plant flow diagram of a plant according to the invention for utilizing the carbon oxides formed in the melt-electrolytic production of aluminum.

In the following, reference will firstly be made to FIGS. 1 and 2 and an illustrative variant of the process of the invention and also an integrated plant which can be used in the process will be explained in more detail with the aid of this schematically simplified depiction. Only the essential plant parts of such an integrated plant are shown by way of example in the drawing. The integrated plant comprises a plant region in which a methane pyrolysis process is carried out, with this plant region comprising, inter alia, a methane pyrolysis reactor 1 in which a pyrolysis of methane or of another hydrocarbon or of natural gas is carried out. For this purpose, methane is fed via a feed conduit 2 to this pyrolysis reactor 1 and energy is supplied to the reactor 1 via a device 5 in order to bring the methane to the temperature of, for example, more than 800° C. required for the pyrolysis. Hydrogen and pyrolysis carbon are formed by the pyrolytic decomposition in the methane pyrolysis reactor 1. The hydrogen is conveyed from the reactor 1 via the conduit 4 into a further reactor 13 in which a reverse water gas shift reaction, which will be explained in more detail later, takes place. The pyrolysis carbon produced in the reactor 1 is fed via a feed device 3 to an apparatus 6 in which anodes for the melt electrolysis are produced from the pyrolysis carbon or a carbon mixture of the abovementioned type. The volatile hydrocarbons formed in the production of the anode are recirculated via a conduit 19 to the methane pyrolysis reactor 1.

A binder, for example pitch, and optionally further carbon sources such as calcined petroleum coke are fed to this apparatus 6 via a further feed device 7 and the electrodes (anodes) produced in this way in the apparatus 6 are then conveyed via a further feed device 8 from the apparatus 6 to the plant 9 in which the melt flux electrolysis of aluminum oxide takes place. This plant 9 is supplied via various feed devices 10, which are depicted here in schematically simplified form only by a single line, with the further starting materials required for the melt flux electrolysis, namely aluminum oxide, cryolite which is used for lowering the melting point of the solids to be melted and also energy which is necessary to bring this mixture of solids to the melting temperature of the eutectic, which is generally about 950° C. Aluminum is then formed as product in this plant 9 and can be discharged from the plant via the discharge device 11, Furthermore, a gas mixture of carbon dioxide and carbon monoxide in a ratio which depends on various parameters in the electrolysis of the aluminum oxide is formed in the plant 9 by oxidation of the anode carbon. This gas mixture is discharged from the plant 9 via the conduit 12 and fed to a reactor 13 for a reverse water gas shift reaction. Part of this gas mixture can alternatively be discharged from the plant 9 via the conduit 20 and fed to the methane pyrolysis reactor 1.

The reverse water gas shift reaction which is carried out in the reactor 13 and proceeds according to the reaction equation (3) above serves to lower the proportion of carbon dioxide in the gas mixture and increase the proportion of carbon monoxide in the gas mixture. For this purpose, the reactor 13 is supplied via the conduit 4 with hydrogen which reacts with the gas mixture from the plant 9 for the melt electrolysis, with energy also being supplied to the reactor 13 via the feed device 14 in order to bring the gas mixture to the appropriately higher temperatures as are necessary to shift the equilibrium of the reverse water gas shift reaction according to reaction equation (3) in the direction of the products carbon monoxide and water. In this way, a synthesis gas which comprises hydrogen, carbon monoxide and optionally a proportion of carbon dioxide is produced in the reactor 13 and this can subsequently be discharged from the reactor 13 via the conduit 15 and fed to a chemical or biotechnological plant 16. Further hydrogen originating from the pyrolysis of methane 1 can optionally be fed to this plant 16 via the conduit 17 drawn in as a broken line in order to increase, for example, the content of hydrogen in the gas mixture.

In principle, the reactor 13 in which the reverse water gas shift reaction takes place can, in a variant of the invention, also be omitted and a gas mixture which is discharged from the melt flux electrolysis via the conduit 12 can be fed directly via a continuous conduit to the plant 16, since this gas mixture from the conduit 12 already comprises carbon monoxide and the required hydrogen can be fed directly via the conduit 17 to the chemical or biotechnological plant 16, so that a mixture of carbon monoxide, optionally carbon dioxide and hydrogen from the methane pyrolysis is ultimately provided in the plant 16 and this gas mixture is a synthesis gas which can then be reacted in the plant 16 to give a further product such as methanol or another alcohol. This product is then discharged from the chemical or biotechnological plant 16 via the conduit 18.

According to the present invention, a gas stream 15, which can be passed to a further use, is thus in the simplest case produced by mixing a hydrogen-comprising gas stream 4 with a gas stream 12 comprising at least carbon monoxide from the melt flux electrolysis 9. The reactor 13 for the reverse water gas shift reaction can be omitted, so that the two gas streams 4 and 12 can be combined upstream of the chemical or biotechnological plant 16 and then fed via a conduit 15 to the plant. However, when the reactor 13 is omitted, it is likewise possible to feed hydrogen 4 and carbon monoxide and/or carbon dioxide 12 as separate gases to the plant 16, so that mixing of these gas streams in principle takes place only in the plant 16. This variant is likewise encompassed by the scope of protection of the present invention.

LIST OF REFERENCE NUMERALS

1 Methane pyrolysis process comprising methane pyrolysis reactor
2 Feed conduit for methane or other hydrocarbons
3 Feed device for pyrolysis carbon
4 Conduit for hydrogen
5 Device for the supply of energy
6 Apparatus for anode production
7 Feed device for binder and optionally petroleum coke or other carbons
8 Feed device for anodes
9 Plant for the melt flux electrolysis
10 Feed devices for energy, aluminum oxide and cryolite
11 Discharge device for aluminum
12 Conduit for gas mixture
13 Reactor for reverse water gas shift reaction
14 Feed device for energy
15 Conduit for synthesis gas
16 Chemical or biotechnological plant
17 Conduit for hydrogen
18 Discharge device for chemical products
19 Conduit for volatile hydrocarbons
20 Conduit for gas mixture
21 Conduit for methane from the methanation plant

The invention claimed is:

1. A process for utilizing carbon oxides formed during an electrolytic production of aluminum by electrolytic reduction of aluminum oxide, the process comprising:
carrying out a pyrolysis of hydrocarbons, in which pyrolysis carbon and hydrogen are formed, and
mixing the hydrogen formed in the pyrolysis of the hydrocarbons with carbon dioxide and/or carbon monoxide from the electrolytic production of aluminum, to produce a gas stream which is passed to a further use,
wherein the electrolytic reduction of aluminum oxide is in a melt using at least one anode made of a carbon-comprising material, and
wherein the pyrolysis carbon is used to produce the at least one anode.

2. The process according to claim 1, further comprising:
feeding a hydrogen-comprising gas stream and a gas stream comprising carbon dioxide and/or carbon monoxide, or a gas stream comprising a mixture of hydrogen and carbon dioxide and/or carbon monoxide, to a reverse water gas shift reaction in which at least part of the carbon dioxide is reacted with hydrogen and reduced to carbon monoxide, to produce a synthesis gas stream.

3. The process according to claim 2, wherein the synthesis gas stream is subsequently fed to a chemical or biotechnological plant.

4. The process according to claim 2, wherein the synthesis gas stream is used for producing methanol, methane, at least one alcohol, and/or at least one other chemical.

5. The process according to claim 1, wherein a ratio of carbon dioxide and carbon monoxide in a gas stream obtained in the electrolytic production of aluminum is set via selection of an anodic current density in an electrolysis.

6. The process according to claim 1, wherein a ratio of carbon dioxide and carbon monoxide in a gas stream obtained in the electrolytic production of aluminum is set via selection of a temperature of an electrolyte.

7. The process according to claim 1, wherein a ratio of carbon dioxide and carbon monoxide in a gas stream obtained in the electrolytic production of aluminum is set via selection of a reactivity of the pyrolysis carbon of the at least one anode.

8. The process according to claim 1, wherein volatile hydrocarbons formed in the production of the at least one anode are recirculated via a conduit to a reactor for the pyrolysis of hydrocarbons.

9. The process according to claim 1, wherein part of the carbon oxides formed in the electrolytic production of aluminum is recirculated via a conduit to a reactor for the pyrolysis of hydrocarbons.

10. The process according to claim 1, wherein the hydrocarbons are natural gas or methane.

* * * * *